United States Patent [19]

Puhak

[11] 4,126,371

[45] Nov. 21, 1978

[54] CRT PIN ALIGNMENT MEANS

[75] Inventor: Peter G. Puhak, Seneca Falls, N.Y.

[73] Assignee: GTE Sylvania Incorporated, Stamford, Conn.

[21] Appl. No.: 857,596

[22] Filed: Dec. 5, 1977

[51] Int. Cl.[2] ..... H01J 5/54; H01R 33/76

[52] U.S. Cl. ..... 339/144 T; 313/318

[58] Field of Search ..... 339/144 T, 145 T; 313/318, 320, 331

[56] References Cited

U.S. PATENT DOCUMENTS

| | | | |
|---|---|---|---|
| 4,064,412 | 12/1977 | Johnson | 339/144 T X |
| 4,075,531 | 2/1978 | Marino | 313/318 X |

*Primary Examiner*—Roy Lake
*Assistant Examiner*—E. F. Desmond
*Attorney, Agent, or Firm*—William H. McNeill

[57] ABSTRACT

Pressure-related means are provided for insuring the retention of discrete pin aligning insert means within a compatible structural component of a cathode ray tube base.

8 Claims, 7 Drawing Figures

CRT PIN ALIGNMENT MEANS

CROSS-REFERENCE TO RELATED APPLICATION

Filed concurrently herewith and assigned to the assignee of the present invention, is a related application Ser. No. 857,597.

BACKGROUND OF THE INVENTION

This invention relates to a means for assuring discrete pin alignment in a cathode ray tube-base assembly and more particularly to improved means for achieving alignment of at least one CRT pin spatially encompassed within a substantially tubular isolation component of the associated base member.

Noteworthy achievement in cathode ray tube technology, in particular the tube types employed in color television receivers has resulted in the development of compact electron gun structures evidencing greater efficiencies. These compact guns, being oriented within tube envelope neck portions of reduced diameter, have the necessary operating voltages for the various elements thereof (heaters, cathodes, accelerating and focusing electrodes, etc.) supplied via an annular array of connector pins sealed into and projecting from the stem closure portion of the tube. As the neck diameter of the tube envelopes become smaller, the spacing between the connector pins likewise decreases.

Prior art tubes have evidenced large voltage differentials between certain of the pins in the connector array. This differential, sometimes in the order of 5KV to 12KV, has necessitated the incorporation of some form of arc protection into the tube base and socket combination. Base and socket means have been designed in the art to minimize inter-pin arcing wherein at least one of the vulnerable high voltage pins is tubularly encompassed by one or more spatially related isolation structures integrally formed as part of the base member. In conjunction therewith, a compatible socket member has receiving means to mate with the respective tubularly encompassed pin, thereby effecting an isolated high voltage connection. This type of protective connection was found to be very beneficial.

To prevent the isolated pin from being bent out of alignment during tube basing or as a result of subsequent tube mishandling, a pin aligning insert has been devised for positioning within the pin accommodating tubulation. The body member of this insert means has a longitudinal bore therein to protectively encompass the pin during tube basing and thereby prevent its being bent. Desirably, this protective insert is retained within the base during the period between tube basing and ultimate usage. But, due to the interplay of manufacturing tolerances and thermal contractions and expansions, the inserts are not always engaged within the tubular structure to the degree desired. Consequently, in certain instances, bumping of the tube during shipment or storage may cause the protective insert to become disengaged.

OBJECTS AND SUMMARY OF THE INVENTION

Accordingly, it is an object of the invention to reduce and obviate the aforementioned disadvantage that has been evidenced in the art.

It is another object of this invention to fashion the insert in a manner to insure retention in the tubular structure of the base and thereby insure protection of the pin as desired.

These and other objects and advantages are achieved in one aspect of the invention wherein improvements in the construction of the pin aligning insert are in the form of compressible retentive protuberances or projections extending outward from the body member of the insert. These protuberances make pressured contact with the inner wall surface of the tubular structure and thereby provide an interference fit when the protective insert is positioned therein. In addition, the insert has a substantially central open-end cavity formed in the body member thereof to promote a degree of resiliency for the compressible retentive protuberances. The improvements of this invention assure positive retention and alignment of the pin-protective insert within the base structure.

DESCRIPTION OF THE PREFERRED EMBODIMENTS

For a better understanding of the present improvement invention, together with other and further objects, advantages and capabilities thereof, reference is made to the following specification and appended claims in connection with the aforedescribed drawings.

Figure 1:
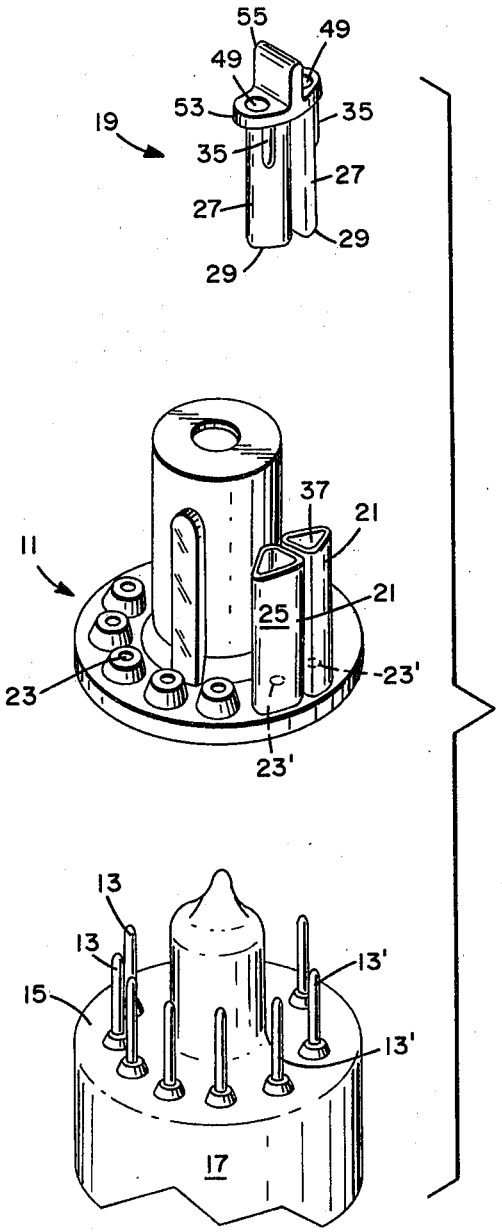
FIG. 1 is an exploded perspective view showing the manner in which the invention is associated with a CRT base and the respective tube pin/pins contained therein.

With reference to the drawings, there is shown in FIG. 1 an exploded presentation wherein a specifically fabricated cathode ray tube base 11, having tubular pin isolating means incorporated therein, is oriented to receive the conventional terminal array of connector pins 13, 13' protruding from the neck closure portion 15 of a CRT 17.

Associated with the base 11 is a pin alignment means 19 formed for insertion into the tubular isolation means 21 of the base to assure desired alignment and protection of the respective tube pins 13' positioned therein.

In greater detail, the base 11 comprises a substantially annular array of pin receiving apertures 23, 23'. At least one of these apertures 23' has a tubular pin isolating means 21 integrally associated therewith.

In the illustrated embodiment, two adjacent apertures 23' are individually surrounded by separate open-end tubular structures 21 which are formed of an encompassing wall 25 to shield the respective tube pins 13 subsequently positioned therein.

The removable pin-alignment means, wherein the improvement invention resides, has, in this instance, two basic longitudinal body members 27 formed of a suitable non-rigid material such as polyethylene and fashioned for insertion into the respective open-ended tubular structures 21 of the base. Each body member has forward and rearward ends 29 and 31 defining a body length therebetween which at least approximates the depth of the tubular means 21. The cross-sectional configuration of each insert body member, which in this instance is substantially triangular, is similar to the internal cross-section of the respective receiving tubular means 21 and is dimensionally compatible therewith to facilitate sliding engagement therebetween.

Formed within each of the body members 27 is a longitudinal bore 33 having a tapered entrance from the forward end 29 thereof. This bore is oriented to be in coaxial alignment with the respective base aperture 23' located in the bottom of the tubular structure 21, and is of a depth at least equalling the length of the tube connector pin to be subsequently positioned therein. The bore is diametrically dimensioned to provide protective, substantially contiguous, encompassment of the pin.

Figure 6:
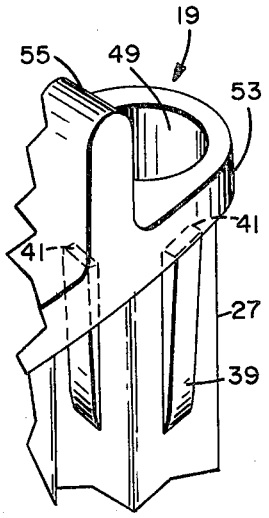
FIGS. 6 and 7 are partial perspective views illustrating alternate embodiments of the invention.
Figure 7:
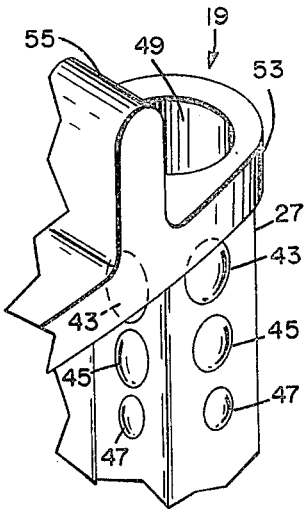

On the outer surface of each of the insert body members 27 are compressible retentive protuberances 35 which, in this instance, are formed to extend longitudinally forward from substantially the rearward end 31 thereof. In this particular instance there are three equally spaced protuberances, and as shown, these spatially-related protuberances are located to insure centering of the insert within the receiving tubular means, and are formed in a manner to make pressured engagement with the inner wall surface 37 of the tubular structure 21 thereby providing a positive retention interference fit when the insert is positioned therein. As illustrated in FIGS. 6 and 7, alternate embodiments of the protuberances include, for example, inclined plane formations 39 whereof the maximum height 41 is substantially proximal the rearward end 31 of the insert member. Another embodiment of the protuberances may be in the form of a series of blister-like nubbins 43,45,47 which extend substantially longitudinally forward from substantially the rearward end of the member.

The pin aligning insert means 19 also has a substantially centrally oriented open-end longitudinal cavity 49 formed in the body member 27 inward from the rearward end 31 thereof to promote a degree of resiliency for the retentive protuberances 35 when the insert is positioned within the tubular means 21 of the base 11. The cavity, in this instance, is substantially circular in cross-section and evidences a diameter "*d*" at least one-half the cross-sectional dimension "D" of the body member 27.

Figure 2:
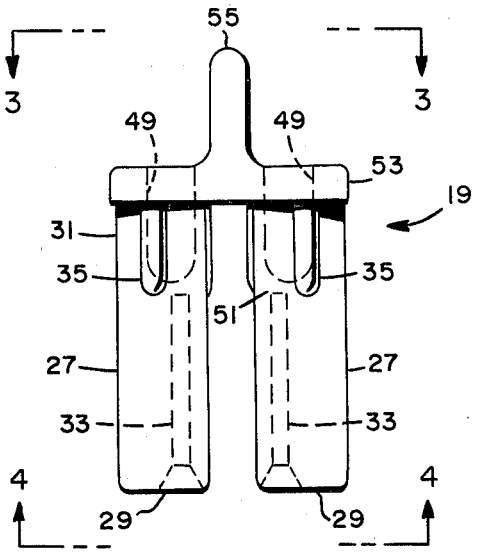
FIG. 2 is an elevational illustration of a dual insert means detailing improvements provided by the invention.
Figure 3:
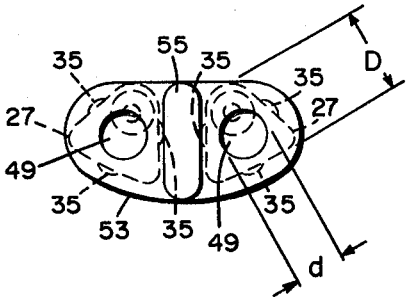
FIG. 3 is a rearward end view taken along the line 3—3 of FIG. 2.
Figure 4:
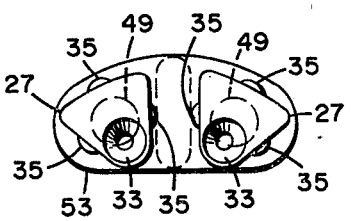
FIG. 4 is a forward end view taken along the line 4—4 of FIG. 2.

As shown in FIG. 2, both the cavity 49 and the longitudinal bore 33 respectively formed within the body member 27, from opposing ends thereof, have individual depths or length dimensions of values to provide a barrier of body material 51 therebetween.

As illustrated, the pair of body members are joined at their rearward ends by a yoke 53 from which tongue-like handle means 55 projects in an upstanding manner outward from the central portion of the yoke substantially mid-way between the respective body cavities 49. This tongue-like handle enables facile placement and removal of the pin alignment insert 19 into and from the tubular structure 21 in the base.

In utilization, the pin aligning insert means 19 is positioned within the tubular pin isolating means 21 of the base member 11, wherein it is centered and retained by the several compressible protuberances 35 on the surface of the body member which make pressured holding engagement with the inner surface 37 of the tubular isolation means 21 of the base 11.

Figure 5:
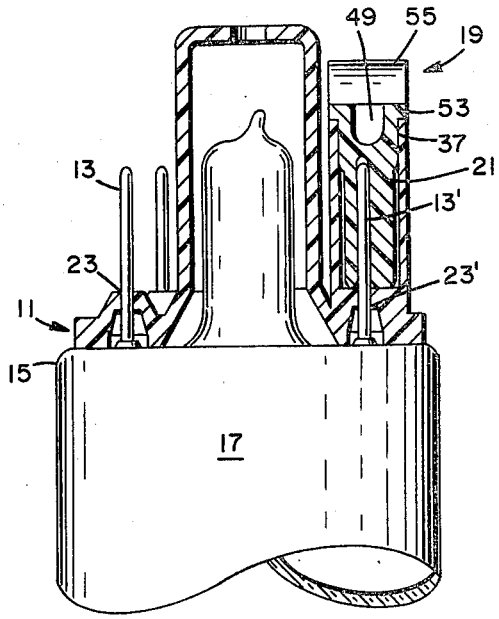
FIG. 5 is an elevational view, partially in section, illustrating the tube base mounted on a cathode ray tube with the improved pin protective and aligning insert in position.

The base 11, with the insert nesting securely therein, is then ready for mating with the closure portion 15 of the cathode ray tube 17. This is accomplished by inserting the array of pins 13, 13' through the appropriate base apertures and then firmly seating and securing the base 11 against the tube closure portion 15. The integrated assembly is shown in FIG. 5.

As described, the pin aligning and protective insert means 19 is desirably retained within the tubular pin isolating structure until a subsequent time when external socket is to be attached thereto. This invention provides compressible pressure-related means for insuring positive retention of the pin-protective insert 19 within the tubular isolation means 21. By this invention retention of the insert 19 within the base 11 is assured regardless of the possible inter-play of tolerances and expensive and contractive thermal characteristics of the components involved.

While there has been shown and described what are at present considered the preferred embodiments of the invention, it will be obvious to those skilled in the art that various changes and modifications may be made therein without departing from the scope of the invention as defined by the appended claims.

What is claimed is:

1. In a cathode ray tube-base combination wherein a substantially annular array of tube connector pins exteriorly protrude through a plurality of apertures in the base member whereof at least one pin is isolated by traversing a base aperture encompassed by a spatially related tubular isolation structure integrally formed as part of said base member and having a length exceeding that of the isolated pin positioned therein, an improved removable insert means for assuring positive alignment of said isolated pin within said tubular structure comprising: a longitudinal body member formed of a non-rigid material for insertion into said tubular structure, said member having forward and rearward ends and a length at least approximating the depth of said isolation structure, said member evidencing a lateral configuration similar to the internal cross-section of said tubular structure and being dimensionally compatible to facilitate insertion thereinto; said body member having a longitudinal bore formed therein from the forward end thereof to receive and provide substantially contiguous encompassment of said isolated pin, the outer surface of said member having a compressible retentive protuberance formed thereon in a manner to make pressured contact with the inner wall surface of said tubular structure thereby providing an interference fit when said insert is positioned therein, said member having a substantially central longitudinal open-end cavity formed therein inward from said rearward end to promote degree of resiliency for said retentive protuberance.

2. The pin aligning insert means of claim 1 wherein a plurality of equally spaced protuberances are provided.

3. The pin aligning insert means according to claim 2 wherein said retention protuberances are substantially elongated nubbin formations extending longitudinally forward from substantially the rearward end of said body member.

4. The pin aligning insert means according to claim 2 wherein said retentive protuberances are substantially inclined plane formations evidencing a maximum height substantially proximal the rearward end of said body member.

5. The pin aligning insert means according to claim 2 wherein said retentive protuberances are a series of blister-like nubbins extending substantially longitudinally forward from substantially the rearward end of said body member.

6. The pin aligning insert means according to claim 2 wherein said cavity is substantially circular in cross-section and has a diameter at least one-half the cross-sectional dimension of said body member.

7. The pin aligning insert means according to claim 2 wherein said cavity and said bore respectively formed within said body member have individual length dimensions of values to provide a barrier of body material therebetween.

8. The improved pin aligning insert means according to claim 2 wherein said tube-base combination evidences two related isolated pins each having a surrounding tubular structure, and wherein said insert means is formed as a pair of body members joined at their rearward ends by a yoke.

* * * * *